US007174809B1

(12) United States Patent
Schipul

(10) Patent No.: US 7,174,809 B1
(45) Date of Patent: Feb. 13, 2007

(54) HAMMER

(76) Inventor: David B. Schipul, 14946 54th Way North, Clearwater, FL (US) 33760

( * ) Notice: Subject to any disclaimer, the term of this patent is extended or adjusted under 35 U.S.C. 154(b) by 0 days.

(21) Appl. No.: 11/295,315

(22) Filed: Dec. 5, 2005

Related U.S. Application Data

(60) Provisional application No. 60/632,768, filed on Dec. 3, 2004.

(51) Int. Cl.
*B25D 1/14* (2006.01)

(52) U.S. Cl. ..... 81/20; 81/26

(58) Field of Classification Search ..... 81/20, 81/26

See application file for complete search history.

(56) References Cited

U.S. PATENT DOCUMENTS 1,262,515 A * 4/1918 Kingsley ..... 81/20
2,709,938 A * 6/1955 Schmid ..... 72/479
2,906,150 A * 9/1959 Stewart ..... 72/466.6
4,240,478 A * 12/1980 Wilson ..... 81/20

* cited by examiner

*Primary Examiner*—David B. Thomas
(74) *Attorney, Agent, or Firm*—Kenneth L Tolar

(57) ABSTRACT

A hammer for eliminating misguided hammer strikes includes an elongated handle having an upper end with a head attached thereto. The head includes two oppositely facing striking surfaces, one of which is concave. Centrally positioned within the concave striking surface is a bull's-eye. As the concave striking surface impacts the nail head, the nail head is directed toward the bull's-eye preventing the striking surface from sliding off the nail.

3 Claims, 1 Drawing Sheet

HAMMER

CROSS REFERENCE TO RELATED APPLICATIONS

This application is entitled to the benefit of provisional application No. 60/632,768 filed on Dec. 3, 2004.

BACKGROUND OF THE INVENTION

The present invention relates to a hammer having a concave striking surface for minimizing misguided hammer strikes.

DESCRIPTION OF THE PRIOR ART

Hammers are used by various workers such as carpenters, builders, handymen and hobbyists. To drive a nail, a worker typically holds the nail with one hand and strikes it with a hammer held with the other hand. Because the nail head is relatively small, misguided strikes are common, resulting in smashed fingers and bent or misdirected nails. The present invention addresses this problem by providing a uniquely designed hammer that minimizes misguided hammer strikes.

SUMMARY OF THE INVENTION

The present invention relates to a hammer. The device comprises an elongated handle having an upper end and a lower end. Mounted on the upper end is a head having two oppositely facing striking surfaces. A first striking surface is concave and includes a bull's-eye at a central portion thereof. The opposing striking surface is substantially planar or slightly convex similar to a conventional hammer.

Accordingly, a user directs the hammer head onto a nail in a conventional fashion. If the hammer is misdirected slightly, the concave striking surface will guide the nail head toward the central portion thereof preventing the striking surface from sliding off the nail. If a conventional hammer is needed or desired, a user can direct the planar striking surface onto the nail head.

It is therefore an object of the present invention to provide a hammer that is safer and easier to use than conventional hammers.

It is another object of the present invention to provide a hammer that eliminates the problems associated with misguided hammer strikes.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
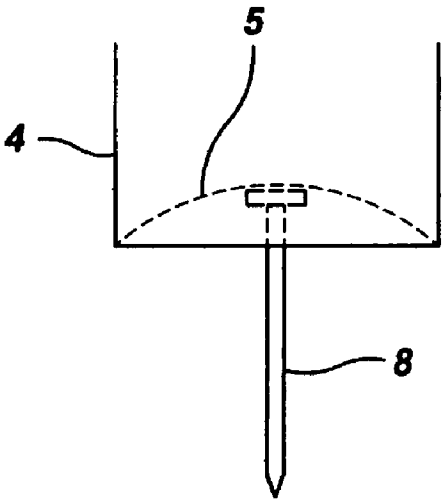
FIG. 2 is a plan, sectional view of the concave striking surface engaging a nail head.
Figure 1:
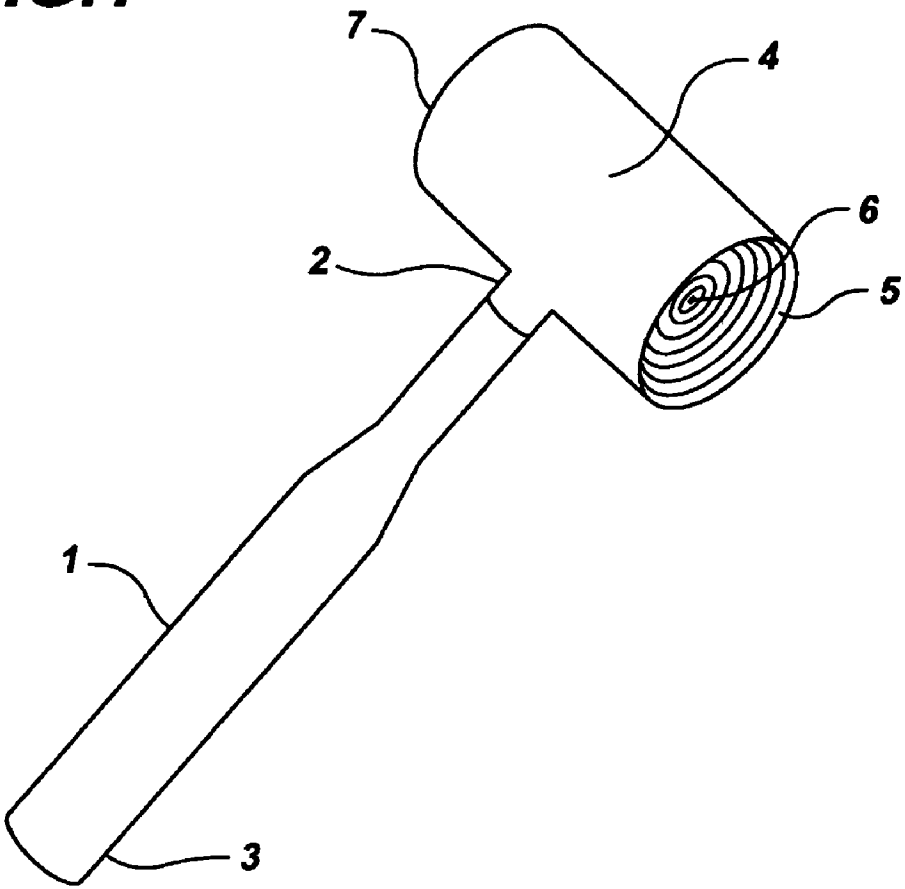
FIG. 1 is a perspective view of the hammer according to the present invention.

The present invention relates to a hammer. The device comprises an elongated handle 1 having an upper end 2 and a lower end 3. Mounted on the upper end is a head 4 having two oppositely facing striking surfaces. A first striking surface 5 is concave and includes a bull's-eye 6 at a central portion thereof. The opposing striking surface 7 is substantially planar or slightly convex similar to a conventional hammer.

Accordingly, a user directs the hammer onto a nail 8 in a conventional fashion. If the hammer is misdirected slightly, the concave striking surface will guide the nail head toward the bull's-eye preventing the striking surface from sliding off the nail. If a conventional hammer is needed or desired, a user can direct the planar striking surface onto the nail head.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A hammer comprising:

an elongated handle having an upper end and a lower end;

a head mounted on the upper end, said head having a first striking surface, wherein said first striking surface is concave and includes a bull's-eye at a central portion thereof;

a second opposing striking surface, said second striking surface being substantially planar.

2. A hammer comprising:

an elongated handle having an upper end and a lower end;

a head mounted on the upper end, said head having a first striking surface, wherein said first striking surface is concave and includes a plurality of concentric ridges with a bull's-eye at a central portion thereof;

a second opposing striking surface, said second striking surface being substantially planar.

3. A hammer comprising:

an elongated handle having an upper end and a lower end;

a head mounted on the upper end, said head having a first striking surface having a continuous outer edge, wherein said first striking surface tapers inwardly from the outer edge toward a central portion so that the entire striking surface is concave, said striking surface including a plurality of concentric ridges with a bull's-eye at the central portion thereof;

a second opposing striking surface, said second striking surface being substantially planar.

* * * * *